US005779444A

United States Patent [19]

Onigata et al.

[11] Patent Number: 5,779,444

[45] Date of Patent: Jul. 14, 1998

[54] CENTRIFUGAL PUMP

[75] Inventors: Junichiro Onigata; Kazuyoshi Kushihara, both of Atsugi, Japan

[73] Assignee: Unisia Jecs Corporation, Atsugi, Japan

[21] Appl. No.: 651,542

[22] Filed: May 22, 1996

[30] Foreign Application Priority Data

May 23, 1995 [JP] Japan ..... 7-123921

[51] Int. Cl.[6] ..... F04D 29/44

[52] U.S. Cl. ..... 415/206

[58] Field of Search ..... 415/206, 208.1

[56] References Cited

U.S. PATENT DOCUMENTS 2,380,606 7/1945 Moody .

FOREIGN PATENT DOCUMENTS 35 17 498 11/1986 Germany .

61-147398 9/1986 Japan .

*Primary Examiner*—John T. Kwon

*Attorney, Agent, or Firm*—Foley & Lardner

[57] ABSTRACT

A centrifugal pump comprises a hollow pump body. An impeller is rotatably installed in a pump chamber defined in the pump body. The impeller has a front side facing a major part of the pump chamber and a rear side facing a bottom wall of the pump chamber. The hollow pump body has both a water discharge passage and a water discharge port formed therein. A water guide ridge is positioned between the pump chamber and the water discharge passage to smooth a water flow from the pump chamber toward the water discharge port. The water guide ridge extends upstream in the water discharge passage and projects from the inner wall toward the major part of the pump chamber. The water guide ridge has an upstream end portion sloped. With this sloped upstream end portion, undesired cavitation in the pump is suppressed or at least minimized.

12 Claims, 4 Drawing Sheets

CENTRIFUGAL PUMP

BACKGROUND OF THE INVENTION

1. Field of the Invention

The present invention relates in general to pumps and more particularly to pumps of a centrifugal type. More specifically, the present invention is concerned with the centrifugal pumps usable as a water pump of a cooling system for water-cooled internal combustion engine.

2. Description of the Prior Art

In order to clarify the task of the present invention, a conventional centrifugal pump disclosed in Japanese Utility Model First Provisional Publication 61-147398 will be briefly described in the following. The pump is described to be used as a water pump of a cooling system of an internal combustion engine.

The centrifugal pump generally comprises a pump casing having a spiral chamber defined therein, an impeller rotatably disposed in the spiral chamber, and a guide ridge formed on a bottom surface of the spiral chamber for guiding driven water toward a discharge port. The guide ridge is located in close vicinity of the periphery of the impeller. That is, the guide ridge is arranged between the spiral chamber and the discharge port for the purpose of moderating a pressure drop generated therebetween.

However, due to its inherent construction, the pump has failed to exhibit a satisfied pumping work. This is because of the arrangement wherein the guide ridge projects perpendicular from the bottom surface of the spiral chamber. In fact, such arrangement tends to cause generation of not a small pressure drop between the spiral chamber and the discharge port, that is, not a small cavitation therebetween. The cavitation causes erosion of the guide ridge and the impeller.

SUMMARY OF THE INVENTION

It is therefore an object of the present invention to provide a centrifugal pump which is free of the above-mentioned drawback.

According to the present invention, there is provided a centrifugal pump which comprises a hollow pump body; an impeller rotatably installed in a pump chamber defined in the pump body, the impeller having a front side facing a major part of the pump chamber and a rear side facing a bottom wall of the pump chamber; means defining in the hollow pump body both a water discharge passage and a water discharge port; and a water guide ridge positioned between the pump chamber and the water discharge passage to smooth a water flow from the pump chamber toward the water discharge port, the water guide ridge extending upstream in the water discharge passage and projecting from the inner wall toward the major part of the pump chamber, wherein the water guide ridge has an upstream end portion sloped.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
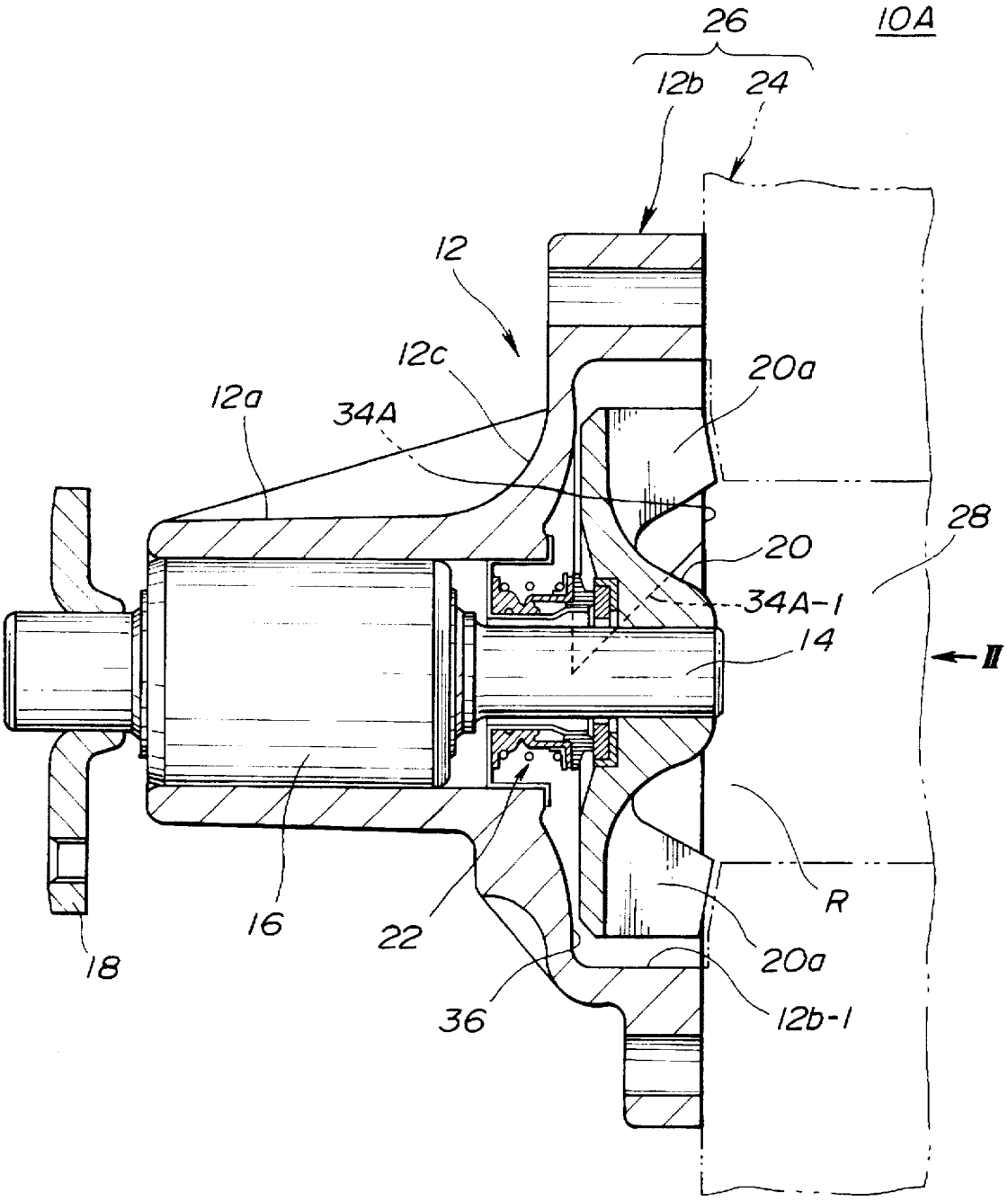
FIG. 1 is a sectional view of a centrifugal pump which is a first embodiment of the present invention.
Figure 2:
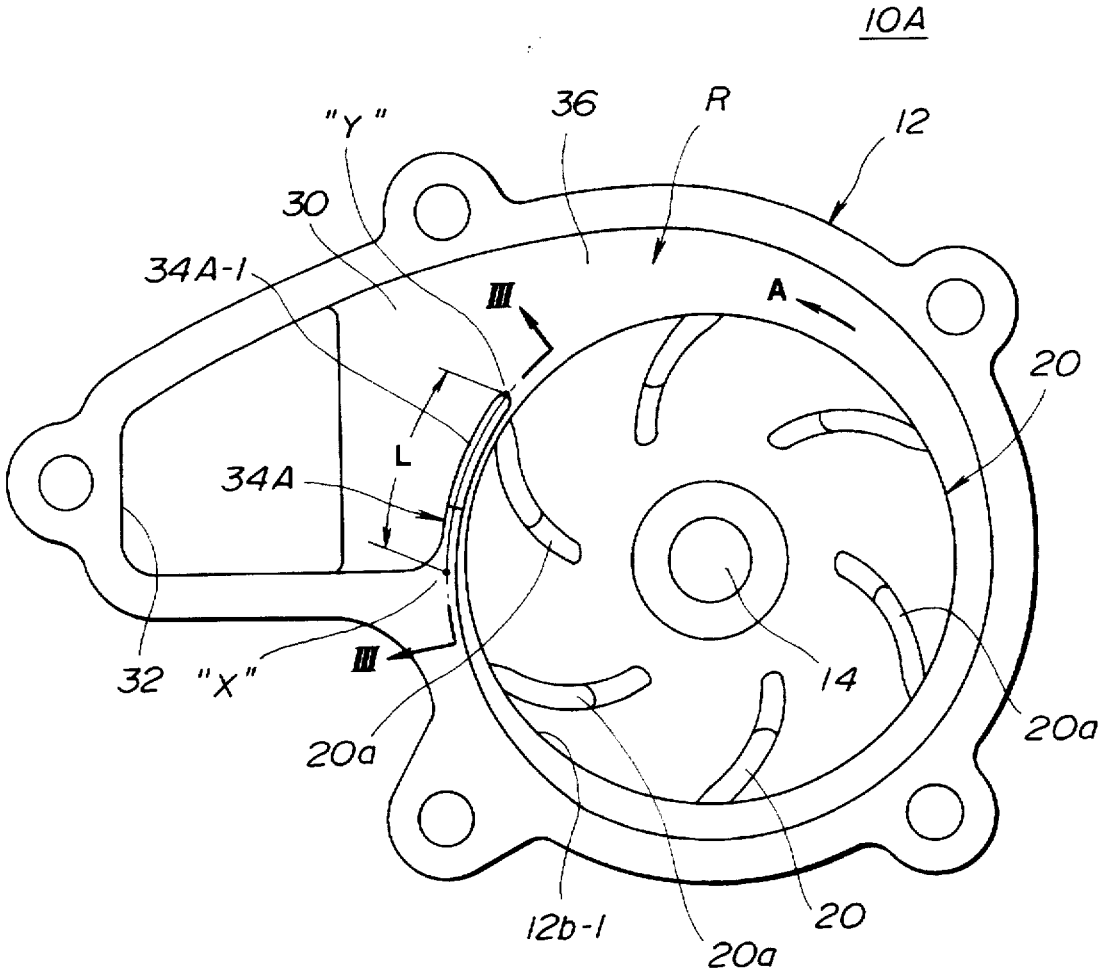
FIG. 2 is a view taken from the direction of the arrow II of FIG. 1.
Figure 3:
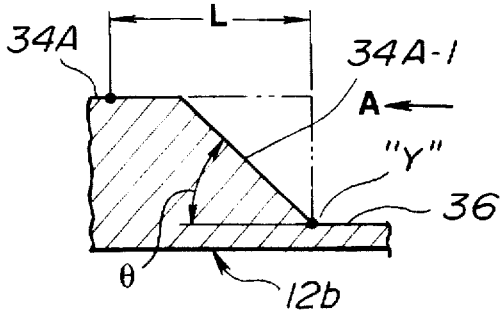
FIG. 3 is a sectional view taken along the line III—III of FIG. 2.

Referring to FIGS. 1 to 3, particularly FIG. 1, there is shown a centrifugal pump 10A which is a first embodiment of the present invention.

The pump 10A comprises a hollow pump body 12 including a smaller diameter portion 12*a*, a larger diameter portion 12*b* and an intermediate annular portion 12*c* through which the smaller and larger diameter portions 12*a* and 12*b* are integrally connected.

Within the smaller diameter portion 12*a* of the pump body 12, there is rotatably disposed a drive shaft 14 through a bearing 16. An exposed end of the shaft 14 has a hub 18 secured thereto. Although not shown in the drawing, a driven pulley is secured to the hub 18 to rotate therewith. When the driven pulley is rotated in a normal direction, the drive shaft 14 is rotated about its axis in the direction of the arrow "A" of FIG. 2.

As shown in FIG. 1, within the larger diameter portion 12*b* of the pump body 12, there is received an impeller 20 which is coaxially disposed on an inner end of the drive shaft 14 to rotate therewith. The impeller 20 is formed at a front side thereof with a plurality of spiral vanes 20*a*.

Between the bearing 16 and the impeller 20, there is arranged a mechanical sealing device 22 which is supported in the smaller diameter portion 12*a*, as shown.

Designated by numeral 24 is an engine block to which the larger diameter portion 12*b* of the pump body 12 is connected to constitute a pump casing 26.

As is understood from FIGS. 1 and 2, within the pump casing 26, there is defined a pump chamber "R" to which the front side of the impeller 20 is operatively exposed.

Within the engine block 24, there is defined an intake port 28 through which engine cooling water is led into the pump chamber "R".

As is seen in FIG. 2, within the pump body 12, there are defined a smoothly curved water discharge passage 30 and a water discharge port 32. As shown, the water discharge passage 30 is arranged to flow the compressed water from the impeller 20 toward the water discharge port 32. The width of the water discharge passage 30 gradually increases with the approach to the water discharge port 32.

As is seen from FIGS. 2 and 1, between the pump chamber "R" and the water discharge passage 30, there is arranged a smoothly curved water guide ridge 34A which projects from a bottom wall 36 of the pump chamber "R" rightward in FIG. 1, that is, toward the engine block 24. The bottom wall 36 is arranged to face a rear side of the impeller 20.

As is seen from FIG. 2, the water guide ridge 34A is located in close vicinity of the periphery of the impeller 20 and extends upstream. That is, the water guide ridge 34A is positioned near the periphery of the impeller 20 in a manner to define therebetween a curved thin triangular space. The length of the water guide ridge 34A is denoted by "L".

More specifically, as is understood from FIG. 2, the water guide ridge 34A extends from one portion "X" on the bottom wall 36 of the pump chamber "R" to the other portion "Y" of the same. The portion "X" is the portion where an imaginary plane defined by a lower surface of the water discharge port 32 as viewed in FIG. 2 intersects a cylindrical inner wall **12*b*-1 of the larger diameter portion 12*b* of the pump body 12. The other portion "Y" is the portion which is upstream of the discharge port 32** by a distance of about "L".

In the first embodiment 10A of the present invention, the following measure is further employed.

As is understood from FIGS. 1, 2 and 3, particularly FIG. 3, the water guide ridge 34A has an upstream end portion 34A-1 sloped. That is, the upstream end portion 34A-1 of the water guide ridge 34A has an upper ridge straightly sloped, which extends from the portion "Y". The inclination angle of the sloped end portion 34A-1 is denoted by "θ" in the drawing.

In the following, operation of the centrifugal pump 10A of the first embodiment will be described with reference to the drawings.

Under rotation of the impeller 20 in the direction of the arrow "A" (see FIG. 2), water is led into the pump chamber "R" from the intake port 28 and forced to flow along the water discharge passage 30 and finally discharged to the outside through the water discharge port 32. Due to provision of the water guide ridge 34A, a pressure drop inevitably produced between pump chamber "R" and the water discharge port 32 is moderated.

Furthermore, due to provision of the sloped end portion 34A-1 of the guide ridge 34A, the moderation of the pressure drop is smoothly carried out. That is, at the zone where the sloped end portion 34A-1 is located, the pressure differential between the pump chamber "R" and the water discharge port 32 is gradually or smoothly changed in the direction in which the impeller 20 rotates. Thus, undesired pressure drop therebetween is effectively reduced or minimized, and thus, undesired cavitation is suppressed or at least minimized.

If, unlike the water guide ridge 34A of the invention, the water guide ridge has a rectangular end portion as is illustrated by a phantom line in FIG. 3, the pressure differential between the pump chamber "R" and the water discharge port 32 is changed abruptly, which causes generation of not a small cavitation at the water guide ridge.

Experiments have revealed that the cavitation suppressing effect increases as the inclination angle "θ" reduces.

Figure 4:
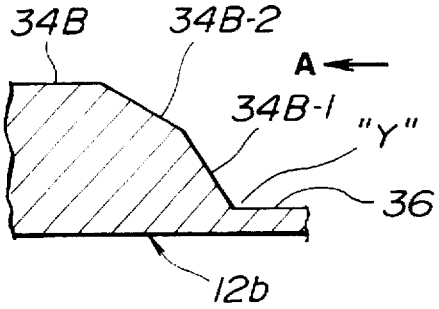
FIGS. 4, 5, 6, 7, 8, 9 and 10 are views similar to FIG. 3, but showing second, third, fourth, fifth, sixth, seventh and eighth embodiments of the present invention.

Referring to FIG. 4, there is shown a smoothly curved water guide ridge 34B employed in a second embodiment of the present invention. As is shown, the water guide ridge 34B of this embodiment has a sloped end portion which consists of two sloped portions 34B-1 and 34B-2.

Figure 5:
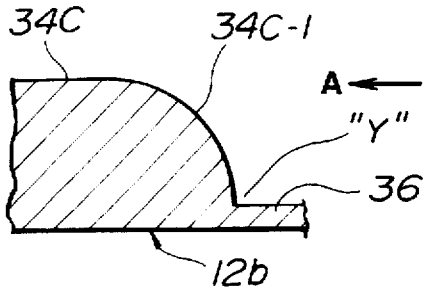

Referring to FIG. 5, there is shown a smoothly curved water guide ridge 34C employed in a third embodiment of the present invention. As is shown, the water guide ridge 34C of this embodiment has a sloped end portion 34C-1 which is convexly shaped.

Figure 6:
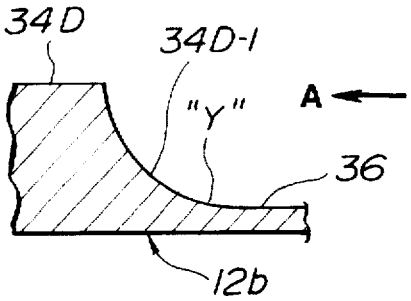

Referring to FIG. 6, there is shown a smoothly curved water guide ridge 34D employed in a fourth embodiment of the present invention. As is shown, the water guide ridge 34D of this embodiment has a sloped end portion 34D-1 which is concavely shaped.

Figure 7:
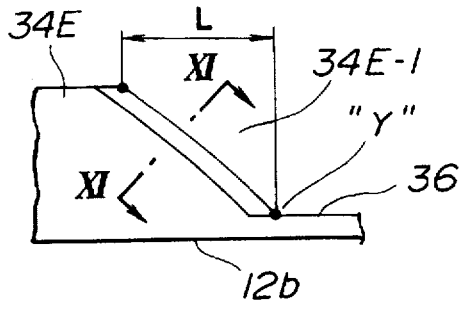
Figure 11:
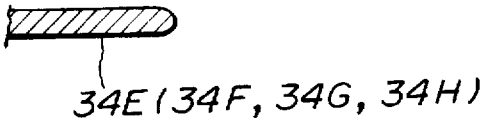
FIG. 11 is a sectional view taken along the line XI—XI of FIGS. 7, 8, 9 and 10.

Referring to FIG. 7, there is shown a smoothly curved water guide ridge 34E employed in a fifth embodiment of the present invention. The water guide ridge 34E of this embodiment is similar to the above-mentioned first embodiment 34A except the shape of the upper edge of the sloped end portion 34E-1. That is, as is seen from FIG. 11, the upper edge of the sloped end portion 34E-1 is smoothly rounded. That is, the upper edge has a semi-circular cross section.

Due to provision of the rounded upper edge, the cavitation suppression effect of the water guide ridge 34E is promoted.

Figure 8:
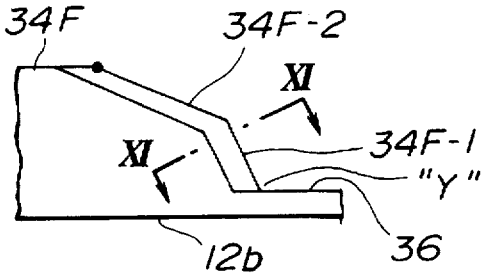

Referring to FIG. 8, there is shown a smoothly curved water guide ridge 34F employed in a sixth embodiment of the present invention. The water guide ridge 34F of this embodiment is similar to the above-mentioned second embodiment 34B. That is, as is seen from FIG. 11, upper edges of the two sloped portions 34F-1 and 34F-2 of the sloped end portion are smoothly rounded.

Figure 9:
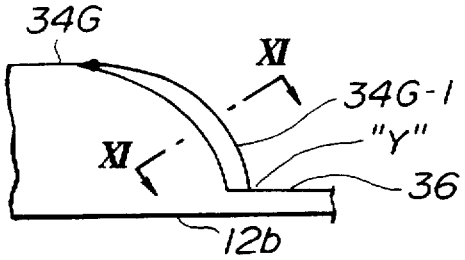

Referring to FIG. 9, there is shown a smoothly curved water guide ridge 34G employed in a seventh embodiment of the present invention. The water guide ridge 34G of this embodiment is similar to the above-mentioned third embodiment. That is, as is seen from FIG. 11, the upper edge of the convexly shaped end portion 34G-1 of the guide ridge 34G is smoothly rounded.

Figure 10:
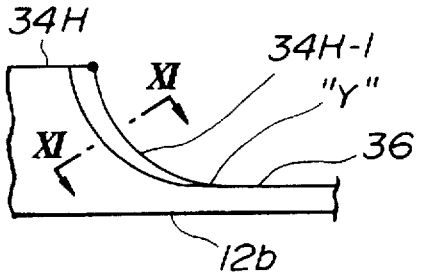

Referring to FIG. 10, there is shown a smoothly curved water guide ridge 34H employed in an eighth embodiment of the present invention. The water guide ridge 34H of this embodiment is similar to the above-mentioned fourth embodiment 34D. That is, as is seen from FIG. 11, an upper edge of the concavely shaped end portion 34H-1 is smoothly rounded.

What is claimed is:

1. A centrifugal fluid pump comprising:

a hollow pump body having a pump chamber at least partially defined therein;

an impeller rotatably installed in said pump chamber, the impeller having a plurality of vanes formed on a front side and a rear side facing a bottom wall of said pump chamber;

a fluid discharge passage and a fluid discharge port being positioned in said hollow pump body downstream of said pump chamber; and a fluid guide ridge being positioned between said pump chamber and said fluid discharge passage to smooth fluid flow from said pump chamber toward said fluid discharge port, said fluid guide ridge rising and extending upstream from said bottom wall across said pump body, wherein said water guide ridge has an upstream end portion profile changing such that the ridge's height increases downstream.

2. A centrifugal pump as claimed in claim 1, in which said fluid guide ridge is smoothly curved in the direction in which fluid flows.

3. A centrifugal pump as claimed in claim 2, in which said fluid guide ridge extends upstream in said fluid discharge passage along a periphery of said impeller in a manner to define therebetween a curved thin triangular space.

4. A centrifugal pump as claimed in claim 3, in which said upstream end portion of said fluid guide ridge has an upper ridge straightly sloped.

5. A centrifugal pump as claimed in claim 3, in which the upstream end portion of said fluid guide ridge consists of two sloped portions.

6. A centrifugal pump as claimed in claim 3, in which the upstream end portion of said fluid guide ridge is convexly shaped.

7. A centrifugal pump as claimed in claim 3, in which the upstream end portion of said fluid guide ridge is concavely shaped.

8. A centrifugal pump as claimed in claim 4, in which the straightly upper edge of the upstream end portion of said fluid guide ridge is smoothly rounded.

9. A centrifugal pump as claimed in claim 5, in which an upper edge of said upstream end portion of said fluid guide ridge is smoothly rounded.

10. A centrifugal pump as claimed in claim 6, in which an upper edge of the convexly shaped end portion of said fluid water guide ridge is smoothly rounded.

11. A centrifugal pump as claimed in claim 7, in which an upper edge of the concavely shaped end portion of said fluid guide ridge is smoothly rounded.

12. A centrifugal pump as claimed in claim 1, in which said fluid guide ridge extends from a first given portion of said bottom wall to a second given portion of said bottom wall, said first given portion being a portion where an imaginary plane defined by a lower surface of said fluid discharge port intersects a cylindrical wall of a larger diameter portion of said pump body in which said impeller is operatively disposed, and said second given portion being a portion which is upstream of said fluid discharge port by a distance of about the length of said fluid guide ridge.

* * * * *